US007166034B2

(12) United States Patent
Hines et al.

(10) Patent No.: US 7,166,034 B2
(45) Date of Patent: Jan. 23, 2007

(54) GOLF BALL DISPENSING AND TEEING DEVICE

(76) Inventors: Steven Wayne Hines, 137 Plantation Cir. S., Ponte Vedra Beach, FL (US) 32082; Kristofor Matthew Kocan, 1175 N. 2nd St., Jacksonville Beach, FL (US) 32250

( * ) Notice: Subject to any disclaimer, the term of this patent is extended or adjusted under 35 U.S.C. 154(b) by 0 days.

(21) Appl. No.: 11/067,258

(22) Filed: Feb. 25, 2005

(65) Prior Publication Data

US 2005/0192109 A1 Sep. 1, 2005

Related U.S. Application Data

(60) Provisional application No. 60/548,381, filed on Feb. 26, 2004.

(51) Int. Cl.
*A63B 69/36* (2006.01)

(52) U.S. Cl. ..... 473/137

(58) Field of Classification Search ..... 473/132–137
See application file for complete search history.

(56) References Cited

U.S. PATENT DOCUMENTS

| | | | | |
|---|---|---|---|---|
| 1,623,782 | A * | 4/1927 | Dent et al. | 473/392 |
| 2,071,356 | A | 2/1937 | Pagett | |
| 2,171,299 | A | 8/1939 | Beckett | |
| 2,212,877 | A * | 8/1940 | Gale | 473/134 |
| 2,675,237 | A | 4/1954 | Willcox | |
| 3,003,770 | A | 10/1961 | Jones | |
| 3,599,983 | A | 8/1971 | Melton | |
| 3,738,662 | A | 6/1973 | Hodgin | |
| 4,265,453 | A | 5/1981 | Loof | |
| 4,796,893 | A | 1/1989 | Choi | |
| 4,957,296 | A | 9/1990 | Turnidge et al. | |
| 4,995,614 | A | 2/1991 | Tange | |
| 5,346,222 | A | 9/1994 | Luther, Sr. | |
| 5,411,267 | A | 5/1995 | Burks et al. | |
| 5,464,223 | A | 11/1995 | Dermott | |

(Continued)

FOREIGN PATENT DOCUMENTS

| | | | |
|---|---|---|---|
| GB | 2258161 | * | 3/1993 |

*Primary Examiner*—Steven Wong
(74) *Attorney, Agent, or Firm*—Thomas C. Saitta

(57) ABSTRACT

A golf ball dispensing and teeing device comprising a ball receptacle for retaining a suitably large quantity of golf balls and delivering them to a ball release mechanism. The ball release comprises an actuator for release of balls from the ball receptacle onto a pivoting ball delivery mechanism, and a pivoting trigger member that controls the release such that balls are released individually. The trigger member is biased to provide a push to the ball and the ball delivery mechanism. The ball delivery mechanism is an elongated track or ramp, and the weight of the golf ball on the track and the push from the trigger member causes the track to pivot downward, such that the ball rolls down the track. A ball teeing structure is provided at the end of the track, and comprises a spout member of generally tubular configuration that stops the lateral movement of the ball and controls its position in the vertical direction. A cut-out is provided on the interior side of the spout to insure there is no contact between the ball and the spout when the spout pivots back to the neutral position. An alignment ring is provided about the base of the spout, which corresponds to an alignment indicator provided on a specialized golf tee.

19 Claims, 11 Drawing Sheets

U.S. PATENT DOCUMENTS

| | | | |
|---|---|---|---|
| 5,549,518 | A | 8/1996 | Wang |
| 5,624,325 | A | 4/1997 | Smith |
| 5,632,687 | A | 5/1997 | Bunyi |
| 5,665,004 | A | 9/1997 | Vlahovic |
| 5,704,844 | A | 1/1998 | Luther |
| 6,179,719 | B1 | 1/2001 | Hwang |
| 6,328,659 | B1 | 12/2001 | Peterson |
| 6,419,589 | B1 | 7/2002 | Carter |

* cited by examiner

GOLF BALL DISPENSING AND TEEING DEVICE

This application claims the benefit of U.S. Provisional Patent Application Ser. No. 60/548,381, filed Feb. 26, 2004, the disclosure of which is incorporated by reference herein.

BACKGROUND OF THE INVENTION

This invention relates generally to the field of devices that dispense and tee golf balls for use on a driving range for golf practice, such that a golfer can hit balls in succession without having to manually re-tee a golf ball after each shot. More particularly, the invention relates to such devices that are easily portable and non-powered, such that the device can be utilized in multiple physical locations and on various surfaces.

Golf ball teeing and dispensing devices are well known and the field of these devices can be divided into several categories. Some such devices utilize powered delivery systems, while others are non-powered. Of the non-powered type, some require the golfer to manually pivot a dispensing arm to deliver and tee the ball, while others require the golfer to actuate the device using a button or the like, with gravity causing the ball to be delivered and teed. Examples of known golf ball dispensing and teeing devices are seen in U.S. Pat. No. 2,071,356 to Pagett, U.S. Pat. No. 2,171,299 to Beckett, U.S. Pat. No. 2,675,237 to Willcox, U.S. Pat. No. 3,003,770 to Jones, U.S. Pat. No. 3,599,983 to Melton, U.S. Pat. No. 3,738,662 to Hodgin, U.S. Pat. No. 4,265,453 to Loof, U.S. Pat. No. 4,796,893 to Choi, U.S. Pat. No. 4,957,296 to Tumidge et al., U.S. Pat. No. 4,995,614 to Tange, U.S. Pat. No. 5,346,222 to Luther, Sr., U.S. Pat. No. 5,411,267 to Burks et al., U.S. Pat. No. 5,464,223 to Dermott, U.S. Pat. No. 5,549,518 to Wang, U.S. Pat. No. 5,624,325 to Smith, U.S. Pat. No. 5,632,687 to Bunyi, U.S. Pat. No. 5,665,004 to Vlahovic, U.S. Pat. No. 5,704,844 to Luther, U.S. Pat. No. 6,179,719 to Hwang, U.S. Pat. No. 6,328,659 to Peterson, and U.S. Pat. No. 6,419,589 to Carter.

The prior art devices suffer from various drawbacks which are addressed by the present invention. Some devices require power in the form of batteries or electrical connections, some are non-portable installations, some involve complicated mechanical systems to deliver and tee the golf ball, and some require use of a mat or special tee. In addition, none of the prior art devices work adequately with tees of varying height or design. Of the devices that utilize gravity to deliver the ball to the tee, none provide means to assist the gravity effect.

It is an object of this invention to provide an improved non-powered, gravity-fed golf ball delivery and teeing device, and in particular such a device with an improved ball release and delivery means, as well as an improved ball teeing means.

SUMMARY OF THE INVENTION

The invention is in general a golf ball delivery and teeing device, wherein golf balls are delivered and teed in succession without the need for the golfer to replace a tee, retrieve a ball, tee the ball, and resume a proper stance in between practice shots. The device is easily portable and non-powered, such that gravity and assist by a specialized trigger mechanism causes the ball to be delivered and teed upon actuation by the golfer, preferably by touching the golf club head to an actuator member.

The golf ball dispensing and teeing device comprises a ball receptacle means for retaining a suitably large quantity of golf balls and delivering them to a ball release means. The ball receptacle means preferably comprises a sloping spiral track such that the balls are retained in an orderly curved line. The ball release means comprises an actuator for release of balls from the ball receptacle means onto a pivoting ball delivery means, and a pivoting trigger member that controls the release such that balls are released individually. The trigger member is biased to provide a push to the ball and the ball delivery means. The ball delivery means is an elongated track or ramp, and the weight of the golf ball on the track and the push from the trigger member causes the track to pivot downward, such that the ball rolls down the track. A ball teeing means is provided at the end of the track, and comprises a spout member of generally tubular configuration that stops the lateral movement of the ball and controls its position in the vertical direction. A cut-out is provided on the interior side of the spout to insure there is no contact between the ball and the spout when the spout pivots back to the neutral position. The device may be utilized with a standard tee or with no tee at all. In an alternative embodiment, an alignment ring is provided about the base of the spout, which corresponds to an alignment indicator provided on a specialized golf tee to allow proper orientation of the tee relative to the device.

DETAILED DESCRIPTION OF THE INVENTION

Figure 2:
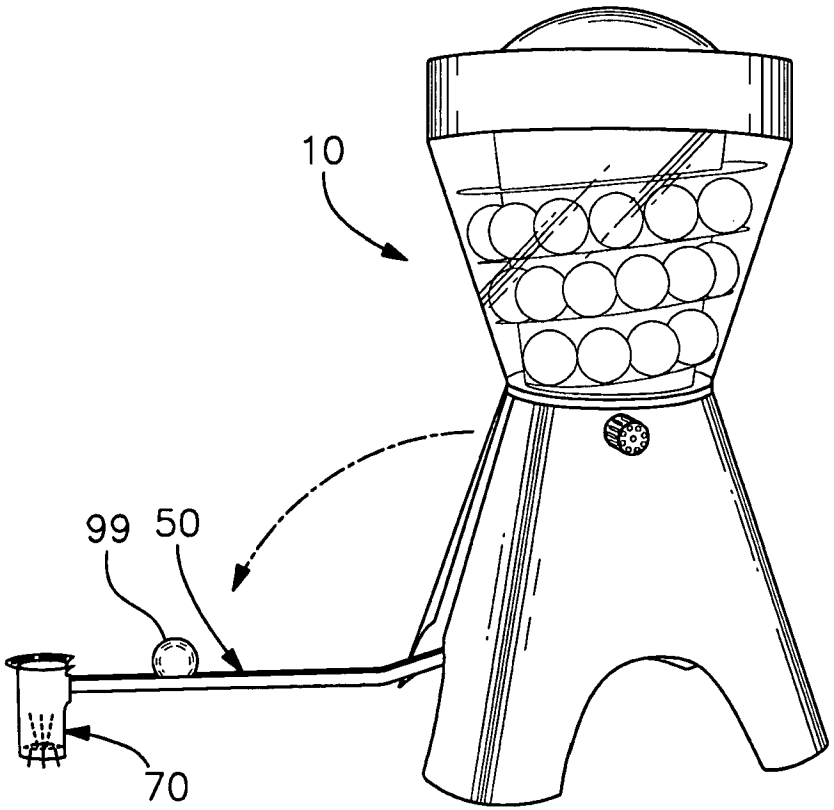
FIG. 2 is a view of the invention with the ball delivery means shown in the active delivery position.
Figure 1:
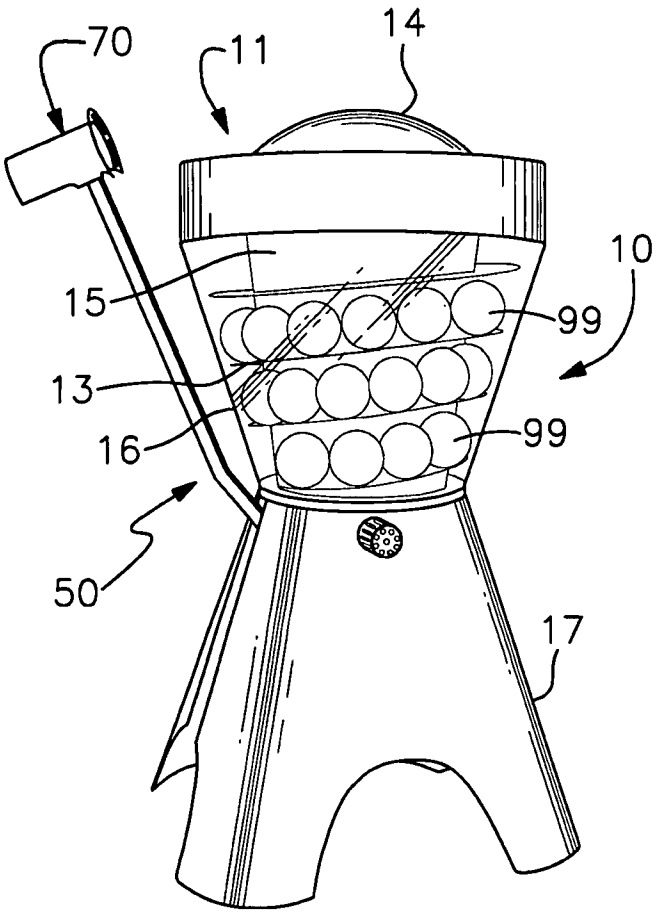
FIG. 1 is a view of the invention with the ball delivery means shown in the upright, neutral position.
Figure 3:
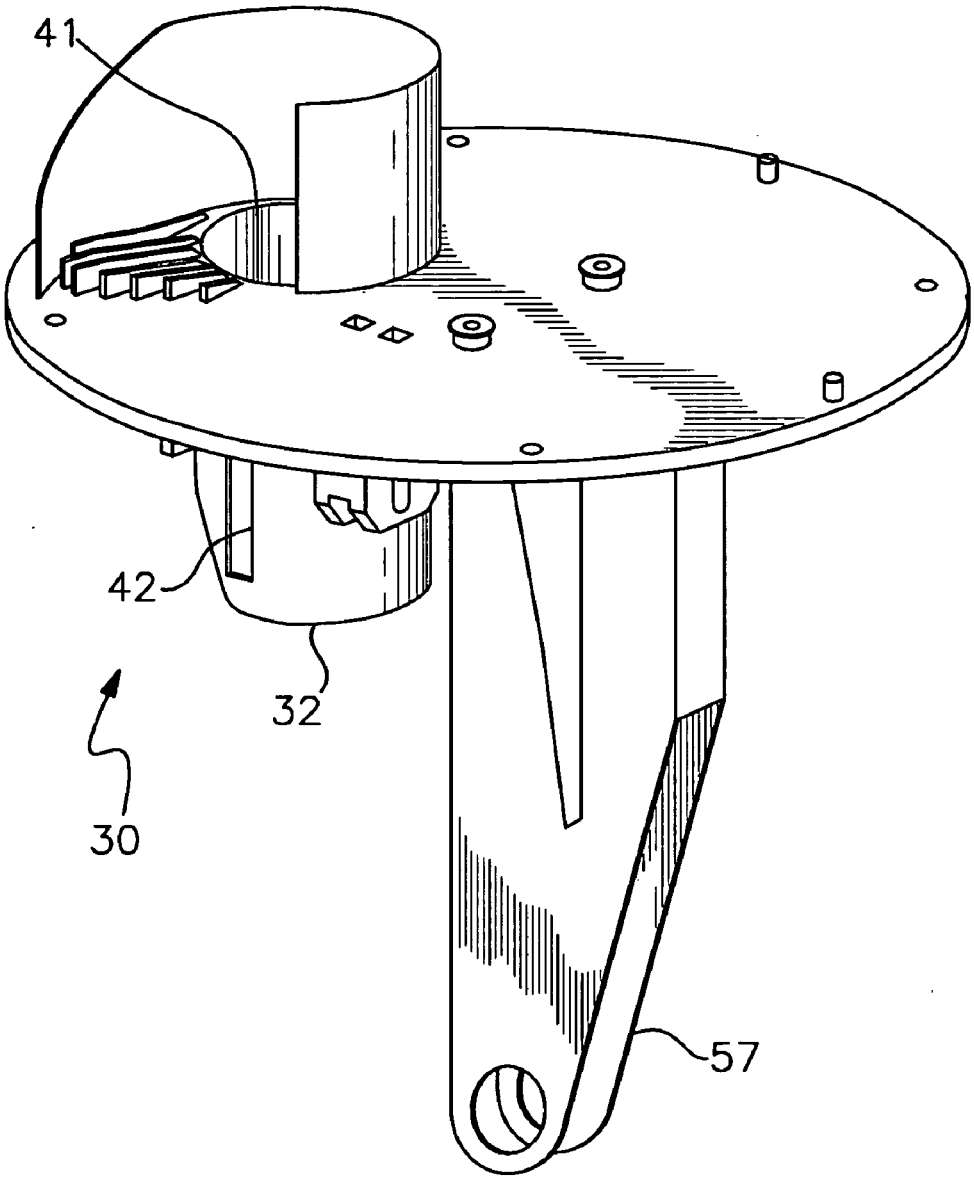
FIG. 3 is an illustration showing the release chute of the ball release means.
Figure 4:
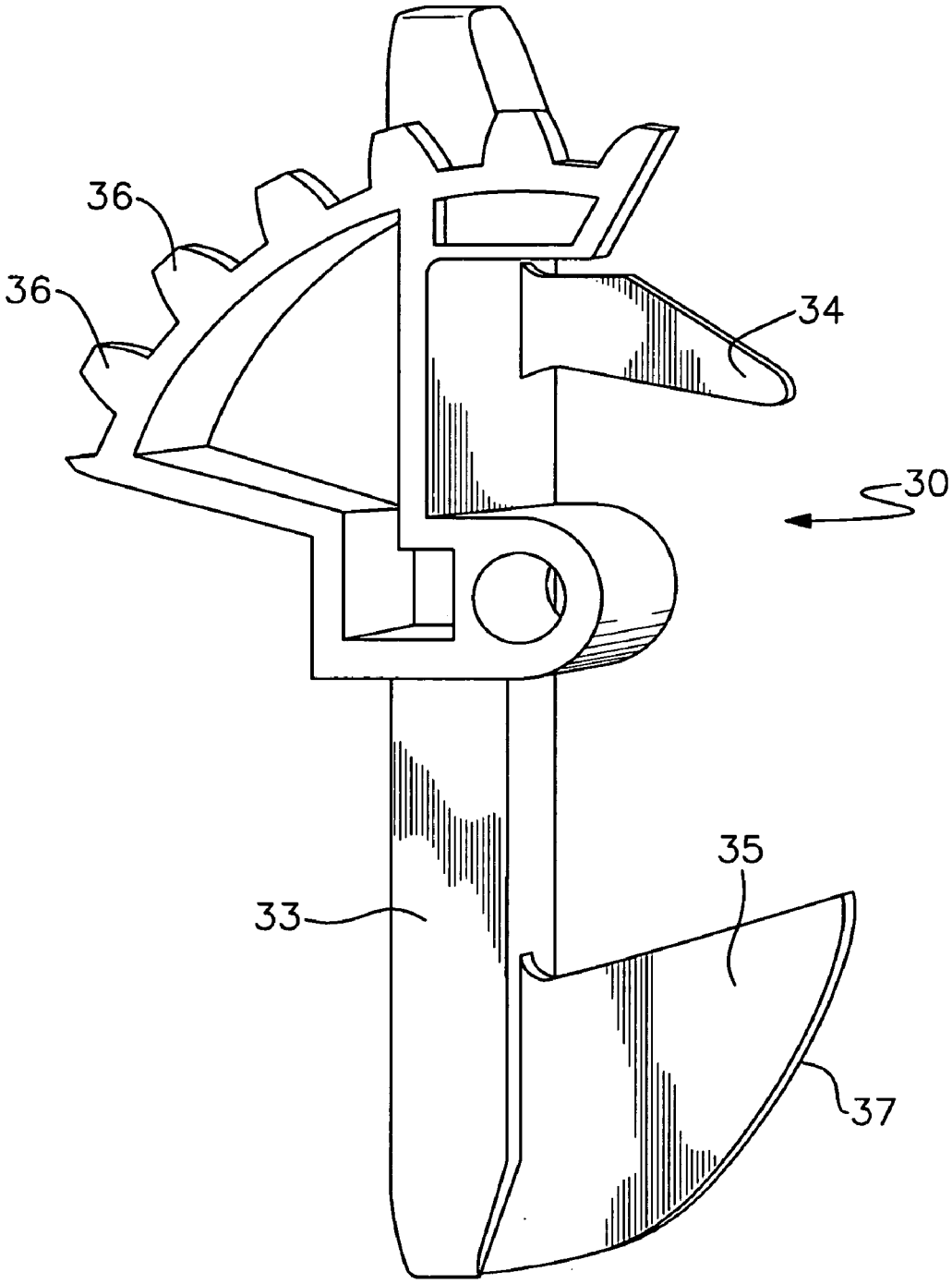
FIG. 4 is an illustration showing the trigger member component of the ball release means.
Figure 5:
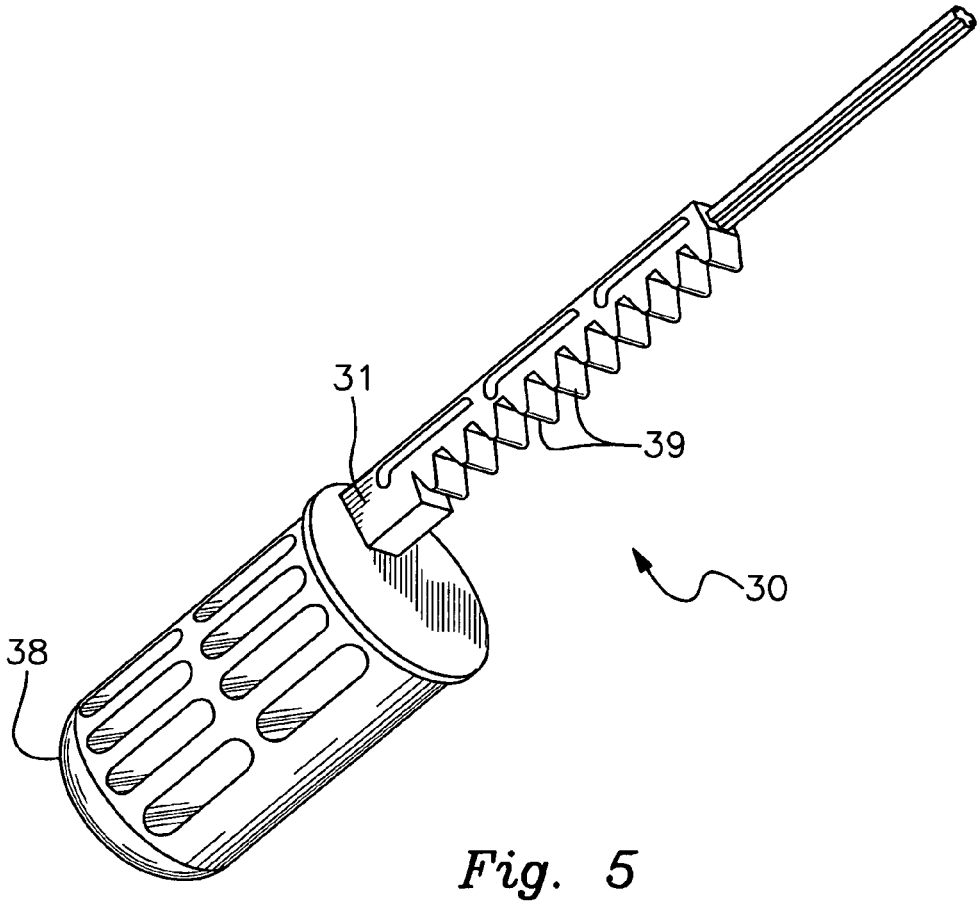
FIG. 5 is an illustration showing the actuator member component of the ball release means.
Figure 6:
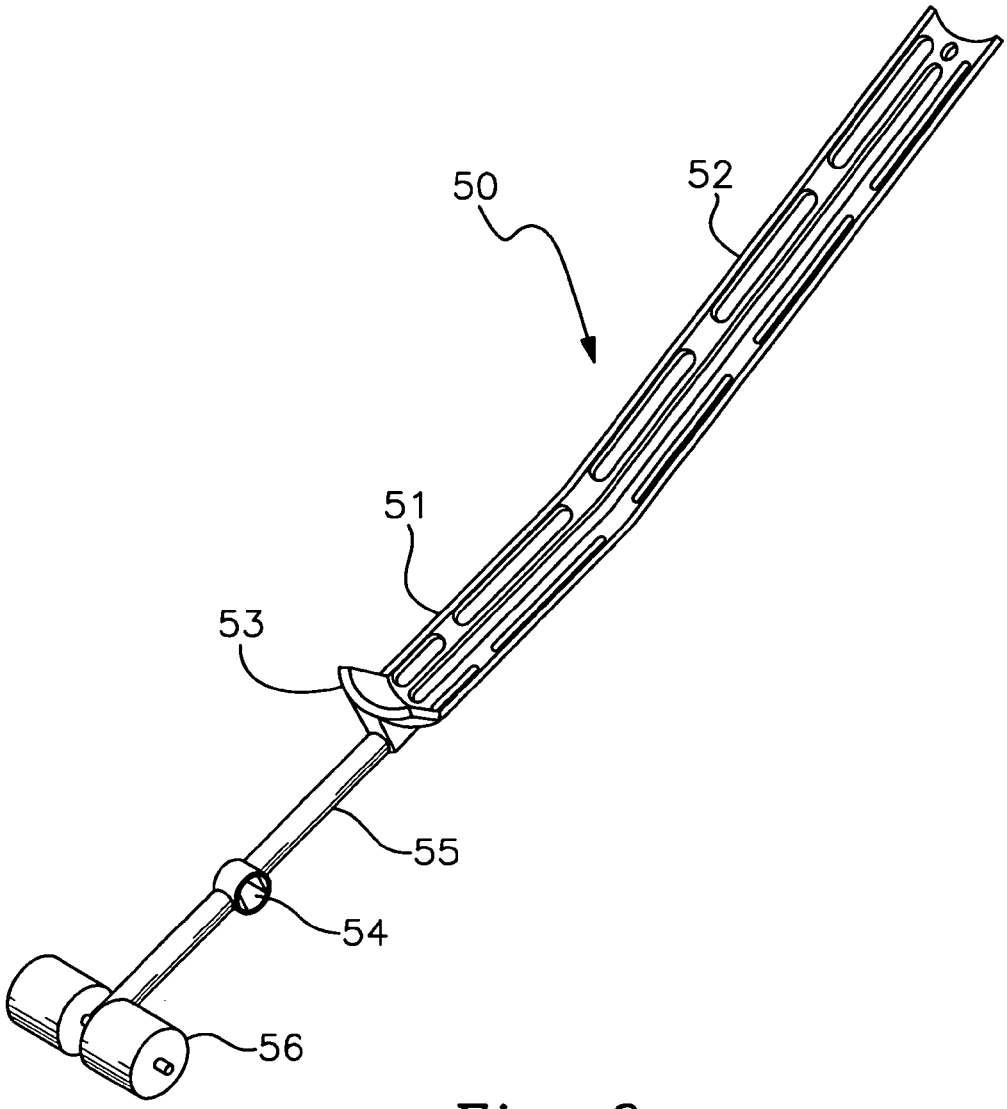
FIG. 6 is an illustration showing the ball delivery means.
Figure 7:
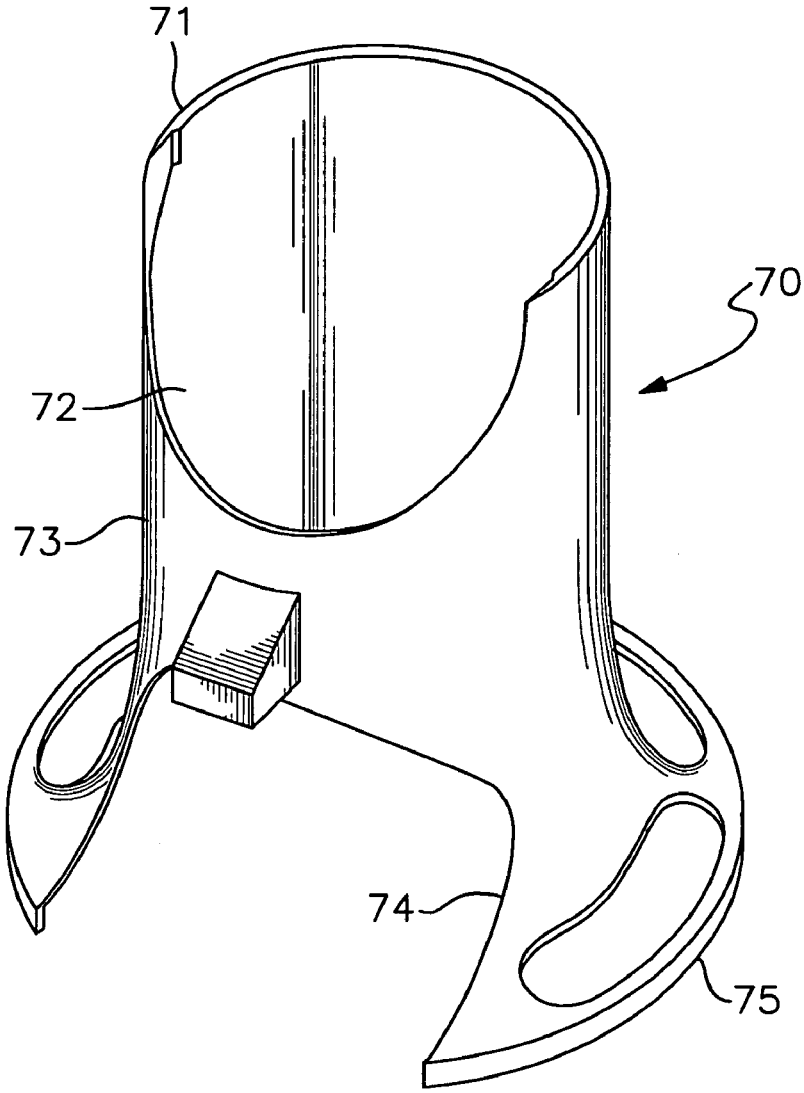
FIG. 7 is an illustration showing the ball teeing means.
Figure 8:
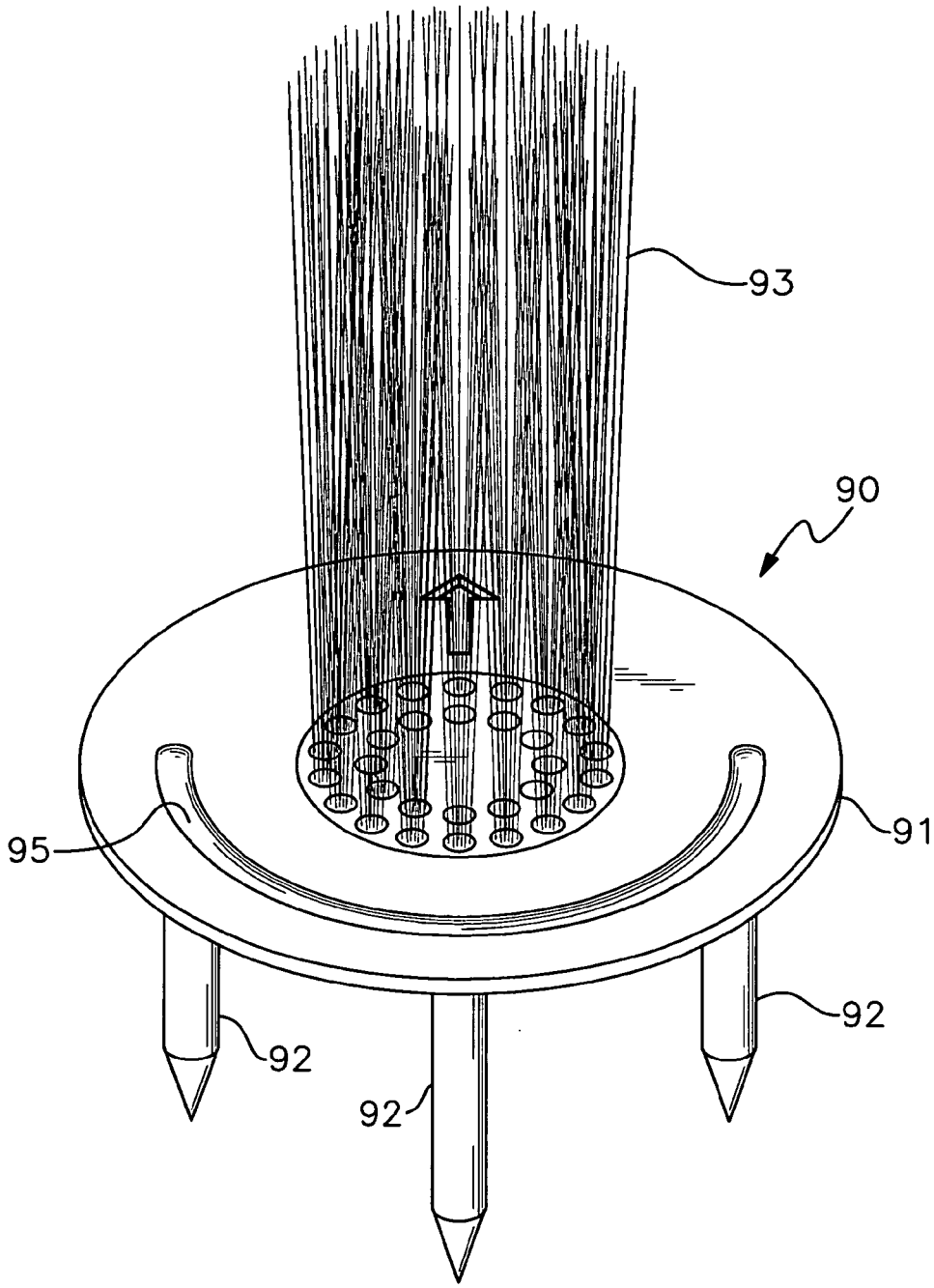
FIG. 8 is an illustration of an embodiment of the tee, wherein the tee comprises a tuft of bristles.
Figure 9:
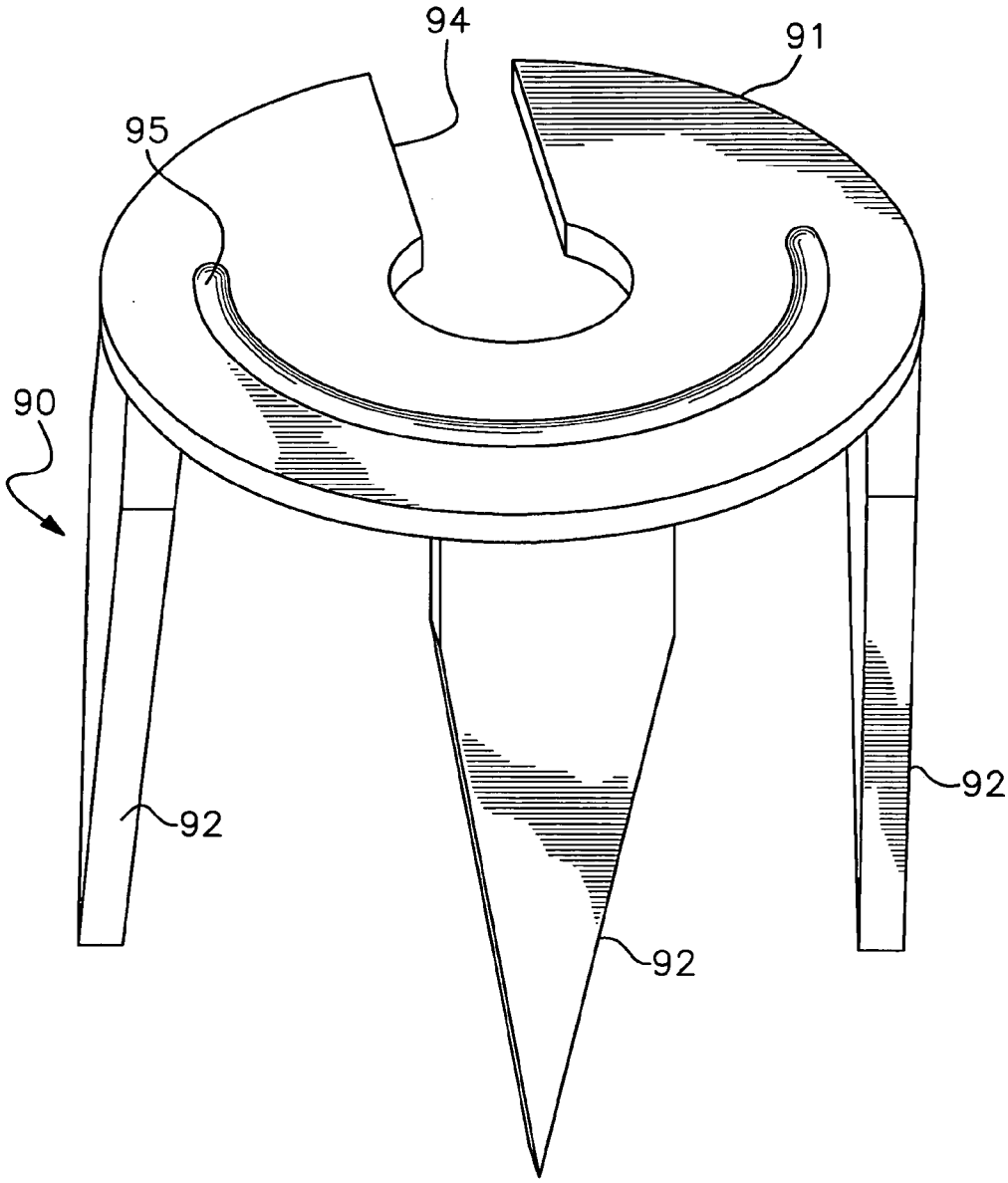
FIG. 9 is an illustration of an embodiment of the tee, wherein the tee comprises a slot to receive a tubular ball holder.
Figure 10B:
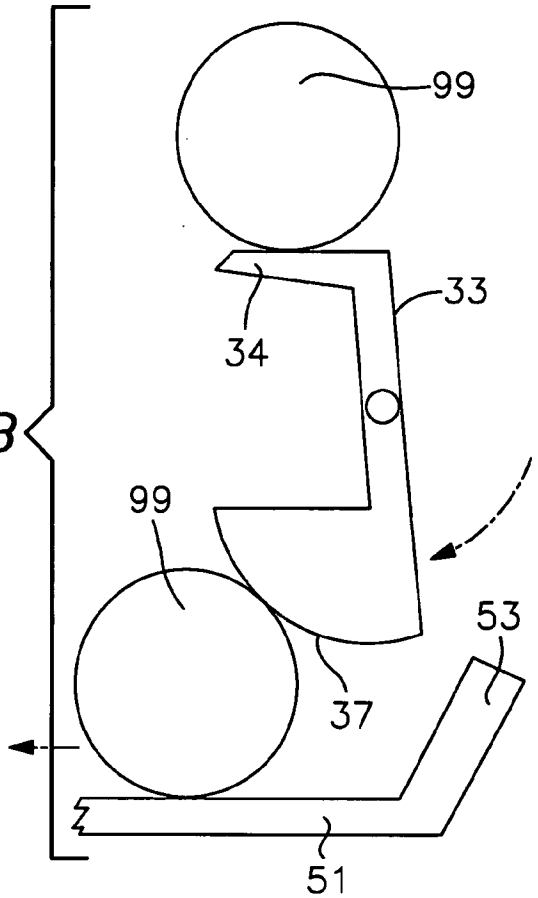
FIG. 10B shows the drive shoulder of the trigger member pushing aginst the released ball and the receiver track to initiate roll and pivoting.
Figure 10A:
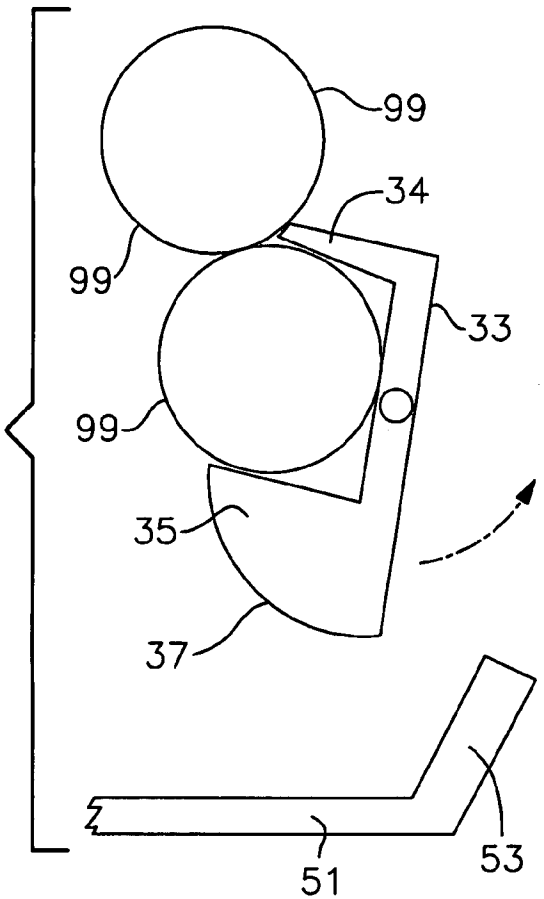
FIG. 10A shows the trigger member being activated to release a ball onto the receiver track.
Figure 11:
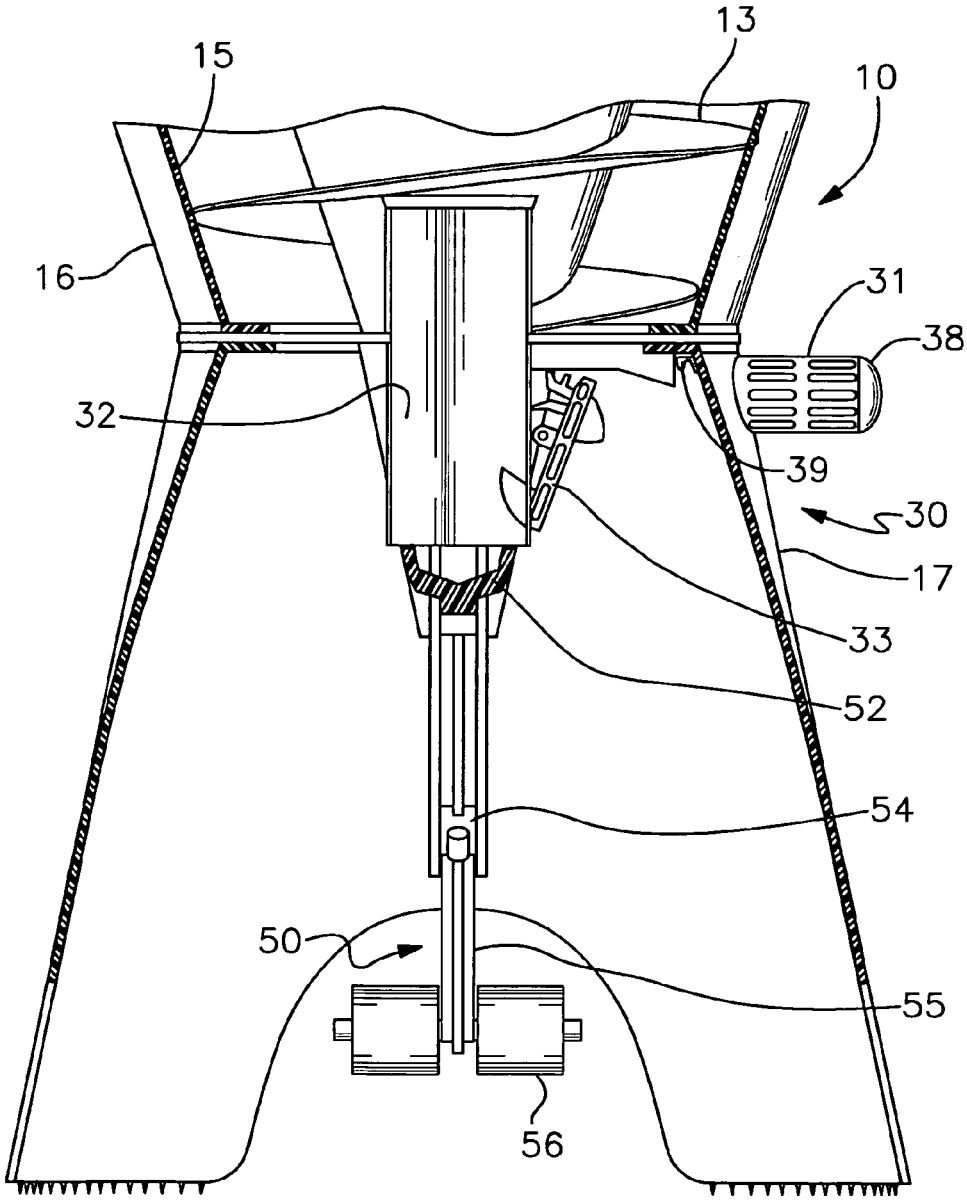
FIG. 11 is an exposed view of the invention showing the relationship between the ball receptacle means, the ball release means and the ball delivery means.
Figure 12:
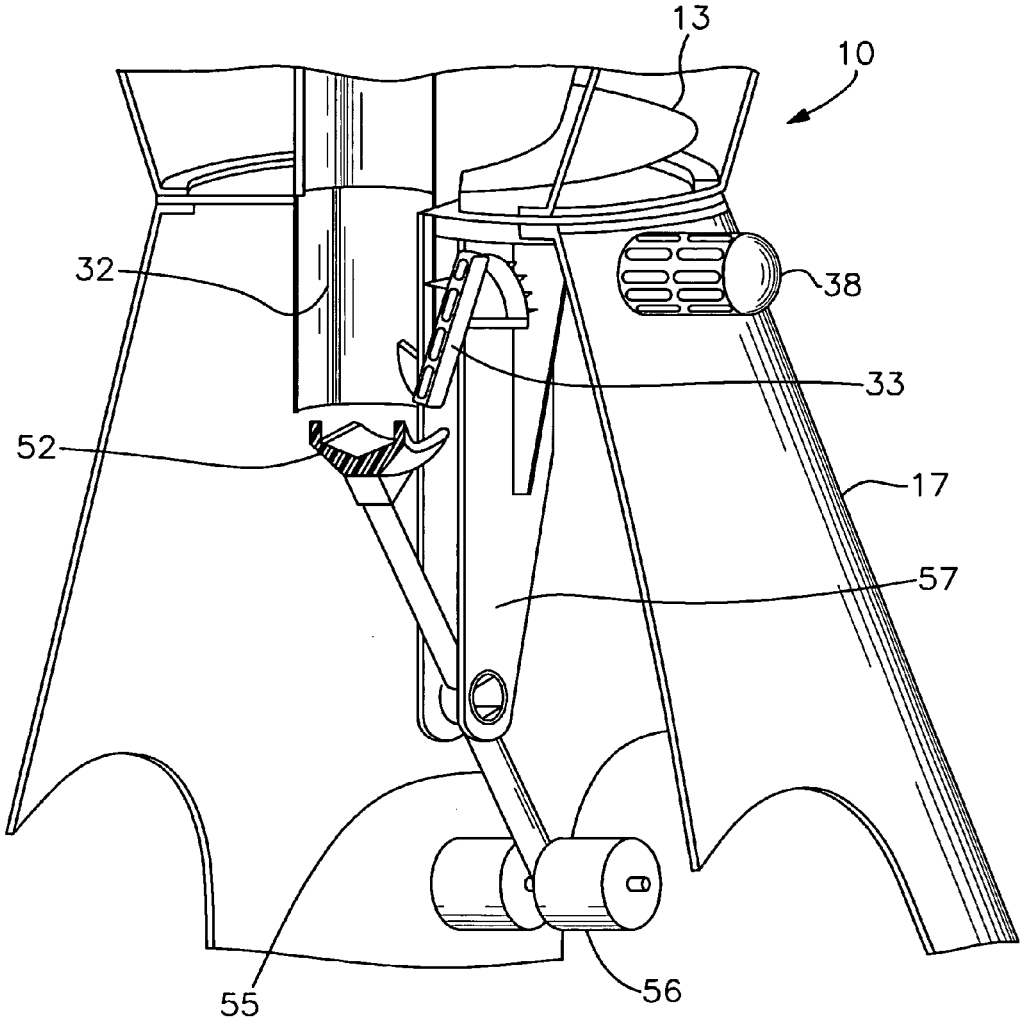
FIG. 12 is an exposed perspective view of the invention showing the relationship between the ball receptacle means, the ball release means and the ball delivery means.

With reference to the drawings, the invention will now be described in detail with regard for the best mode and the preferred embodiment. In its broadest sense, the invention is an improved golf ball dispensing and teeing device, wherein a plurality of golf balls are retained within the device and delivered individually to a tee to be struck by a golfer, where the golfer does not have to abandon his or her stance, position and alignment in between practice shots. The device is non-powered in that the golf balls are delivered and teed using gravity effects. The device is easily portable. The device is capable of placing a golf ball onto various types and sizes of tees, or can be used to deliver golf balls directly onto a hitting surface of either artificial turf or natural grass.

The golf ball dispensing and teeing device comprises in general a ball receptacle means 10, a ball release means 30, ball delivery means 50 and ball teeing means 70. The ball receptacle means 10 comprises a reservoir or bin 11 disposed on a base 17 of suitable structure to provide a stable support on various surfaces. The ball reservoir 11 retains a suitably large quantity of golf balls 99 such that a good number of practice shots can be taken before emptying the reservoir 11 of balls 99. The reservoir 11 is easily refilled by dumping balls 99 from a bucket or the like. There are many suitable designs for the ball receptacle means 10, but the preferred embodiment comprises a sloping spiral track 13 positioned between an inner wall 15 and an outer wall 16, such that the reservoir 11 has a generally inverted conical configuration. A dome member 14 is provided on the top of the reservoir 11 to direct balls 99 into the spiral track 13. The width of the spiral track 13 is such that the balls 99 align in a single file, and gravity plus the weight of the line of balls 99 feeds the lowermost ball 99 to the inlet 41 of the ball release means 30. Use of the spiral track 13 negates the need for an agitator mechanism, which is often required in bucket-type reservoirs where the balls 99 are randomly oriented and can jam together.

The ball release means 30 is a means to control the release of an individual golf ball 99 to be teed, acting as a gate mechanism between the ball receptacle means 10 and the ball delivery means 50. The ball release means 30 functions to receive a single golf ball 99 from the spiral track 13, release the golf ball 99 upon actuation so that it will be properly teed, and receive the next golf ball 99 in line so as to be ready for release upon actuation. The ball release means 30 further functions to initiate downward movement of the ball delivery means 50. The ball release means 30 comprises an actuator member 31 for initiating delivery of the golf ball 99 upon request of the golfer, which is accomplished by the golfer using the club head to depress the exposed end of the actuator 31 formed as a stem or button 38. In the preferred embodiment, the actuator 31 comprises a linear gear 39 having a plurality of teeth disposed longitudinally along a rod or shaft. The actuator member 31 cooperates with a pivoting or rocking trigger member 33 positioned on or adjacent a release chute 32, such that elements of the trigger member 33 extend through the wall of the release chute 32 to control movement of the golf balls 99 within the chute 32.

The release chute 32 is a substantially vertically oriented tubular member with its upper end forming an inlet 41 to receive balls 99 from the lower end of the spiral track 13, the diameter of the chute 32 being slightly greater than the diameter of a ball 99. A single elongated slot or pair of slots 42 is located on the wall of the release chute 32. The trigger member 33 comprises an upper stop arm 34 and a lower stop arm 35 that extend generally laterally. The trigger member 33 is mounted in a pivoting manner such that the upper stop arm 34 and lower stop arm 35 extend through the slot 42, the distance between the upper stop arm 34 and lower stop arm 35 being at least as great as the diameter of a golf ball 99, such that a golf ball 99 can be received between the upper and lower stop arms 34 and 35. The trigger member 33 is provided with a gear 36 having teeth disposed along a curved or partially circular pathway, the teeth being configured to cooperate with the teeth of the linear gear 39 on the actuator member 31. The trigger member 33 is mounted in a pivoting manner, the pivot point occurring between the upper and lower stop arms 34 and 35, whereby linear movement of actuator member 31 is translated into pivoting motion for the trigger member 33. The trigger member 33 and/or the actuator member 31 is spring biased such that in a neutral or non-depressed position, the actuator button 38 is fully extended and the lower stop arm 35 is disposed within the interior of the release chute 32.

The pivoting or rocking motion of the trigger member 33 controls the dispensing of the golf ball 99. With golf balls 99 loaded into the ball receptacle means 10, the lowermost or first ball 99 in the spiral track 13 drops into the release chute 32 and rests upon the upper surface of the lower stop arm 35, which is extended through the wall of the release chute 32. At this time, the upper stop arm 34 is retracted from the interior of the release chute 32, such that the next ball 99 in line rests atop the first ball 99. Depression of the actuator button 38 causes inward movement of the linear gear 39, which in turn causes radial movement of the trigger member gear 36. This pivots the trigger member 33 such that the upper stop arm 34 is inserted into the release chute and between the first and second balls 99, thus preventing downward movement of the upper or second ball 99. The pivoting movement causes withdrawal of the lower stop arm 35 from the release chute 32, such that the first ball 99 drops from the chute 32. At this point, the chute 32 is empty. The trigger member 35 then automatically returns to the neutral position because of the spring bias, such that the lower stop arm is thrust back into the chute 32 and the upper stop arm 34 is withdrawn from the chute 32. This allows the second ball 99 to fall into the release chute 32 to rest on the lower stop arm 35. This operation is repeated in succession until all golf balls 99 are removed from the spiral track 13.

An improved structure for the ball release means 30 comprises drive shoulder 37, which is preferably a curved or cam surface disposed on the underside of lower stop arm 35. As will be described in more detail later, the drive shoulder provides force against the golf ball 99 after it is dispensed from the release chute 32 to the ball delivery means 50, the added force assisting in initiating movement of the ball delivery means 50.

The ball delivery means 50 is an elongated structure mounted beneath the ball release means 30 in a manner that allows it to pivot in a substantially vertical direction about a track mount member 57. The ball delivery means 50 comprises a ball delivery trough or track 52 that extends substantially outward, a ball receiver trough or track 51 adjoined to the delivery track 52 and a counter-balance arm 55 that extends from the opposite side of the receiver track 51. The delivery track 52 and receiver track 51 are configured such that a golf ball 99 will be retained thereon and is free to roll along the length of the tracks 51 and 52. The tracks 51 and 52 may comprise among other possible configurations, a pair of longitudinally extensive rails or ridges, a surface curved in lateral cross-section, or even a tube. Preferably, tracks 51 and 52 are linear and joined at an angle, such that the delivery track 52 is angled slightly upward when the receiver track 51 is oriented in a horizontal position, but the tracks 51 and 52 may also be curved. Pivot means 54 are disposed at a point along the counter-balance arm 55, comprising for example a pair of posts sized to fit into circular apertures on the track mount 57. One or more counter-weights 56 are disposed on the far end of the arm 55. A retainer member 53 is positioned on the receiver track 51 to preclude movement of a ball 99 in the direction away from the delivery track 52. The ball delivery means 50 is positioned such that the ball receiver track 51 is located directly beneath the release chute 32, such that when a ball 99 is released it drops onto the receiver track 51. If the device is properly leveled and the correct counter-weights 56 are chosen, the weight of the ball 99 alone is sufficient to cause the ball delivery means 50 to pivot from the neutral position, where the ball receiving track 51 rests at a slight angle below horizontal and sloping down toward the ball delivery track 52. The ball receiving track 51 and the ball delivery track 52 move downward such that the ball 99 rolls from the receiver track 51 onto the delivery track. The continued movement of the ball 99 down the delivery track 52 results in the free end of the delivery track 52 being pivoted fully down toward the ground surface.

In order to insure that the device operates with optimum efficiency under a wider range of circumstances, the curved drive shoulder 37 is provided on the lower side of the lower stop arm 35 of the ball release means 30. In situations where the device may be slightly off level, where there is a wind pushing against the ball delivery means 50, where the balls 99 are wet, etc., drive shoulder 37 provides additional force beyond that of gravity alone to initiate the pivoting motion of the ball release means 50 and downward ball travel. The ball receiver track 51 is located adjacent the release chute 32 such that when the ball 99 drops from the release chute 32 onto the receiver track 51, the upper side of the ball 99 is contacted by the drive shoulder 37 of lower stop arm 35 of the trigger member 33 as it is biased back to the neutral position. Thus the drive shoulder 37 is a force delivery means that pushes down onto the golf ball 99 and the receiver track 51, helping to initiate the pivoting action. In addition, the extra force increases the roll speed of the ball 99, reducing the time from actuation to ball strike.

Ball teeing means 70 is provided at the end of the ball delivery means 50, and functions to stop motion of the ball 99 down the delivery track 52 such that the ball 99 is positioned atop a tee 90. The ball teeing means 70 as shown comprises a spout member 71 having a ball entry cut-out 72 at the upper end of a tube wall 73, with the entry cut-out 72 facing the delivery track 52 such that the ball 99 passes through the entry cut-out 72 and strikes the interior of the spout member 71. The tube wall 73 is sized to be only slightly greater in diameter than that of the golf ball 99, whereby with the ball 99 situated in the spout member 71 lateral motion in any direction is very limited. The tee 90 is located relative to the device such that the tee 90 is centrally located within the spout member 71 when the bottom of the spout member 71 rests on the ground surface or the disk portion 91 of a tee 90. A clearance cut-out 74, also facing toward the delivery track 51, is provided on the lower end of the tube wall 73 in order that a teed golf ball 99 will not be dislodged by upward movement of the spout member 71. An alignment ring 75 may be provided on the lower end of the tube wall 73 to assist in proper placement of the tee 90. In operation, once the ball 99 is received by the spout member 71 from the delivery track 52, it drops a short distance through the tube wall 73 until it rests on the tee 91. With the weight of the ball 99 now removed from the ball delivery means 50, the counter-weights 56 pivot the ball delivery means 50 back into the upright neutral position ready to receive the next ball 99.

The device may be utilized with tees 90 of varying types. It is preferred that the invention further comprise a tee of a preferred type, the tee 90 comprising a generally circular ground disk 91, one or more spikes or anchors 92 extending downward from the disk 91, and a generally circular tuft of bristles 93 extending upward from the disk 91, the bristles 93 having a concave upper surface in order to retain the golf ball 99. Most preferably, the diameter of the ground disk 91 is significantly greater than the diameter of the tuft of bristles 93 and a plurality of anchor members 92 are provided, as this creates a more secure connection to the ground such that it is less likely that the tee 90 will be displaced when the ball is struck. Most preferably, the anchor members 92 extend a distance equal to or greater than the height of the bristles 93. Even more preferably, the ground disk 91 is provided with a generally circular alignment indicator 95 that corresponds in size to the alignment ring 75 on the ball teeing means 70. The golfer can then properly locate the tee 90 relative to the device by aligning the tee alignment indicator 95 with the alignment ring 75 on the spout member 71 and then lowering the ball delivery means 50 to the ground. In an alternative embodiment, a tee 90 may be provided comprising a slot 94 to receive a short segment of rubber tube, this type of tee being commonly used in golf driving ranges for artificial surfaces. This structure provides for use of a rubber tee by a golfer on natural grass.

It is understood that equivalents and substitutions for certain elements set forth above may be obvious to those skilled in the art, and therefore the true scope and definition of the invention is to be as set forth in the following claims.

We claim:

1. A golf ball dispensing and teeing device comprising:

ball receptacle means to retain a plurality of golf balls;

ball release means to dispense one of said balls from said ball receptacle means, said ball release means comprising a release chute and a pivoting trigger member, said trigger member having an upper stop arm and a lower stop arm, whereby said upper stop arm and said lower stop arm extend into said release chute dependent on the position of said trigger member relative to said release chute, said lower stop arm comprising a drive shoulder;

ball delivery means to deliver said one of said balls from said ball release means, said ball delivery means comprising a pivoting ball receiving track disposed beneath said release chute; and ball teeing means to deposit said one of said balls onto a tee;

whereby upon release of said one of said balls from said release chute, said drive shoulder delivers force against said one of said balls and said ball receiving track to initiate pivoting of said ball delivery means such that said one of said balls rolls from said ball receiving track to said ball teeing means.

2. The device of claim 1, wherein said trigger member is spring biased such that a neutral position for said trigger member is defined with said lower stop arm disposed within said release chute to prevent passage of said one of said balls from said release chute.

3. The device of claim 2, said ball release means further comprising an actuator, whereby actuation of said actuator pivots said trigger member such that said upper stop arm is disposed within said release chute, thereby preventing another of said balls from entering said release chute from said ball receptacle means, and such that said lower stop arm is withdrawn from said release chute, thereby enabling said one of said balls to fall from said release chute.

4. The device of claim 3, whereby upon release of said actuator said trigger member is biased back to said neutral position, thereby enabling said another of said balls to enter said release chute.

5. The device of claim 4, said actuator comprising a toothed linear gear, and said trigger member further comprising a toothed curved gear, whereby linear movement of said toothed linear gear causes rotation of said toothed curved gear, thereby pivoting said trigger member.

6. The device of claim 4, said ball delivery means further comprising a ball delivery track joined to said ball receiving track, and said ball teeing means comprising a spout member joined to said ball delivery track, said spout member comprising a tube wall, a ball entry cut-out on one end of said tube wall to receive said one of said balls from said ball delivery track, and a clearance cut-out on the opposite end of said tube wall.

7. The device of claim 6, further comprising in combination a tee, said tee comprising a ground disk, anchor members extending down from said ground disk, and bristles extending upward from said ground disk, said bristles having a concave surface to retain said one of said balls.

8. The device of claim 7, said spout member of said ball teeing means further comprising an alignment ring, and said tee further comprising an alignment indicator, whereby the proper location of said tee relative to said ball teeing means is accomplished by aligning said alignment indicator with said alignment ring.

9. A golf ball dispensing and teeing device comprising:

ball receptacle means to retain a plurality of golf balls;

ball release means to dispense one of said balls from said ball receptacle means, said ball release means comprising a release chute, an actuator and a pivoting trigger member, said trigger member having an upper stop arm and a lower stop arm, whereby said upper stop arm and said lower stop arm extend into said release chute dependent on the position of said trigger member relative to said release chute, said lower stop arm comprising a drive shoulder that contacts said one of said balls upon release from said release chute;

ball delivery means to deliver said one of said balls from said ball release means, said ball delivery means pivotally mounted relative to said ball release means such that said ball release means pivots in a substantially vertical plane, said ball delivery means comprising a ball receiving track disposed directly beneath said release chute, a ball delivery track connected to said ball receiving track, a counter-balance arm connected to said ball receiving track, and a counter-weight; and ball teeing means to deposit said one of said balls onto a tee;

whereby upon release of said one of said balls from said release chute, said drive shoulder delivers force against said one of said balls and said ball receiving track to initiate downward pivoting of said ball receiving track and said ball delivery track such that said one of said balls rolls from said ball receiving track to said ball delivery track to said ball teeing means, and whereupon deposit of said one of said balls said counterweight causes said ball receiving track and said ball delivery track to pivot upward.

10. The device of claim 9, wherein said trigger member is spring biased such that a neutral position for said trigger member is defined with said lower stop arm disposed within said release chute to prevent passage of said one of said balls from said release chute.

11. The device of claim 10, whereby actuation of said actuator pivots said trigger member such that said upper stop arm is disposed within said release chute, thereby preventing another of said balls from entering said release chute from said ball receptacle means, and such that said lower stop arm is withdrawn from said release chute, thereby enabling said one of said balls to fall from said release chute.

12. The device of claim 11, whereby upon release of said actuator said trigger member is biased back to said neutral position, thereby enabling said another of said balls to enter said release chute.

13. The device of claim 11, said actuator comprising a toothed linear gear, and said trigger member further comprising a toothed curved gear, whereby linear movement of said toothed linear gear causes rotation of said toothed curved gear, thereby pivoting said trigger member.

14. The device of claim 11, said ball teeing means comprising a spout member joined to said ball delivery track, said spout member comprising a tube wall, a ball entry cut-out on one end of said tube wall to receive said one of said balls from said ball delivery track, and a clearance cut-out on the opposite end of said tube wall.

15. The device of claim 14, further comprising in combination a tee, said tee comprising a ground disk, anchor members extending down from said ground disk, and bristles extending upward from said ground disk, said bristles having a concave surface to retain said one of said balls.

16. The device of claim 15, said spout member of said ball teeing means further comprising an alignment ring, and said tee further comprising an alignment indicator, whereby the proper location of said tee relative to said ball teeing means is accomplished by aligning said alignment indicator with said alignment ring.

17. A golf ball dispensing and teeing apparatus comprising in combination:

ball receptacle means to retain a plurality of golf balls;

ball release means to dispense one of said balls from said ball receptacle means;

ball delivery means to deliver said one of said balls from said ball release means;

ball teeing means to deposit said one of said balls onto a tee, said ball teeing means comprising a spout member having an alignment ring; and a tee, said tee comprising a ground disk, anchor members extending down from said ground disk, and a tuft of bristles extending upward from said ground disk, said tuft of bristles having a concave surface to retain said one of said balls;

said tee further comprising an alignment indicator, whereby the proper location of said tee relative to said ball teeing means is accomplished by aligning said alignment indicator with said alignment ring of said spout member;

said ball release means comprising a release chute, an actuator and a pivoting trigger member, said trigger member having an upper stop arm and a lower stop arm, whereby said upper stop arm and said lower stop arm extend into said release chute dependent on the position of said trigger member relative to said release chute, said lower stop arm comprising a drive shoulder that contacts said one of said balls upon release from said release chute; and said ball delivery means pivotally mounted relative to said ball release means such that said ball release means pivots in a substantially vertical plane, said ball delivery means comprising a ball receiving track disposed directly beneath said release chute, a ball delivery track connected to said ball receiving track, a counter-balance arm connected to said ball receiving track, and a counter-weight;

whereby upon release of said one of said balls from said release chute, said drive shoulder delivers force against said one of said balls and said ball receiving track to initiate downward pivoting of said ball receiving track and said ball delivery track such that said one of said balls rolls from said ball receiving track to said ball delivery track to said ball teeing means, and whereupon deposit of said one of said balls said counterweight causes said ball receiving track and said ball delivery track to pivot upward.

18. The apparatus of claim 17, wherein said trigger member is spring biased such that a neutral position for said trigger member is defined with said lower stop arm disposed within said release chute to prevent passage of said one of said balls from said release chute;

whereby actuation of said actuator pivots said trigger member such that said upper stop arm is disposed within said release chute, thereby preventing another of said balls from entering said release chute from said ball receptacle means, and such that said lower stop arm is withdrawn from said release chute, thereby enabling said one of said balls to fall from said release chute; and whereby upon release of said actuator said trigger member is biased back to said neutral position, thereby enabling said another of said balls to enter said release chute.

19. The apparatus of claim 18, said ball teeing means comprising a spout member joined to said ball delivery track, said spout member comprising a tube wall, a ball entry cut-out on one end of said tube wall to receive said one of said balls from said ball delivery track, and a clearance cut-out on the opposite end of said tube wall.

* * * * *